US012202585B2

(12) United States Patent
Garner

(10) Patent No.: US 12,202,585 B2
(45) Date of Patent: Jan. 21, 2025

(54) JET PUMP PROPULSION SYSTEM

(71) Applicant: Garner Development Services, LLC, Irving, TX (US)

(72) Inventor: Steven George Garner, Winnipeg (CA)

(73) Assignee: Garner Development Services, LLC, Irving, TX (US)

( * ) Notice: Subject to any disclaimer, the term of this patent is extended or adjusted under 35 U.S.C. 154(b) by 0 days.

(21) Appl. No.: 18/811,311

(22) Filed: Aug. 21, 2024

(65) Prior Publication Data

US 2024/0409196 A1 Dec. 12, 2024

Related U.S. Application Data

(63) Continuation of application No. PCT/US2024/026613, filed on Apr. 26, 2024.

(60) Provisional application No. 63/462,289, filed on Apr. 27, 2023.

(51) Int. Cl.

| | |
|---|---|
| ***B63H 11/08*** | (2006.01) |
| ***B63H 21/17*** | (2006.01) |
| ***B63H 21/38*** | (2006.01) |
| ***B63H 23/24*** | (2006.01) |
| ***B63J 2/12*** | (2006.01) |

(52) U.S. Cl.

CPC ..... *B63H 11/08* (2013.01); *B63H 21/17* (2013.01); *B63H 21/383* (2013.01); *B63H 23/24* (2013.01); *B63J 2/12* (2013.01); *B63H 2011/081* (2013.01)

(58) Field of Classification Search

CPC .. B63H 21/17; B63H 23/24; B63H 2023/245; B63H 11/04; B63H 2011/043; B63H 2011/046; B63H 11/08; B63H 2011/081; B63H 2011/082; B63H 2011/084; B63H 2011/085; B63H 21/383; B63J 2/12

See application file for complete search history.

(56) References Cited

U.S. PATENT DOCUMENTS

| | | | | |
|---|---|---|---|---|
| 5,101,128 | A | 3/1992 | Veronesi et al. | |
| 5,490,768 | A * | 2/1996 | Veronesi ..... | B63H 11/02 417/423.12 |
| 6,293,836 | B1 | 9/2001 | Blanchard | |
| 6,600,249 | B2 | 7/2003 | Nelson et al. | |
| 6,606,578 | B1 | 8/2003 | Henderson et al. | |
| 6,796,858 | B2 | 9/2004 | Dusablon et al. | |
| 6,884,129 | B2 | 4/2005 | Forest et al. | |

(Continued)

FOREIGN PATENT DOCUMENTS

EP 3758196 A1 12/2020

OTHER PUBLICATIONS

Ahmad; Motor stator busbars for EV traction motors; www.planetanalog.com/motor-stator-busbars-for-ev-traction-motors/; Aug. 30, 2023.

(Continued)

*Primary Examiner* — Ajay Vasudeva

(74) *Attorney, Agent, or Firm* — Law Office of Bill Naifeh

(57) ABSTRACT

Embodiments of a jet pump system are disclosed where certain embodiments comprise an inlet component, an electronic controller which is cooled via the inflow of water through the inlet component, a combined motor impeller system positioned adjacent to the outflow aperture of the inlet component, and a nozzle pump positioned adjacent to the outflow of the motor impeller system.

2 Claims, 16 Drawing Sheets

(56) References Cited

U.S. PATENT DOCUMENTS

| | | | | |
|---|---|---|---|---|
| 7,226,324 | B2 | 6/2007 | Roos | |
| 8,911,271 | B2 * | 12/2014 | Shibayama | B63H 11/08 440/38 |
| 10,167,067 | B2 | 1/2019 | Suzuki et al. | |
| 10,689,078 | B2 | 6/2020 | Desch et al. | |
| 10,953,957 | B2 * | 3/2021 | Tian | B63B 32/00 |
| 11,377,185 | B2 | 7/2022 | Pennestri | |
| 11,381,126 | B1 | 7/2022 | Thomasson et al. | |
| 2003/0186601 | A1 | 10/2003 | Collier et al. | |
| 2009/0102305 | A1 | 4/2009 | Lu | |
| 2010/0119389 | A1 | 5/2010 | Lazebnik et al. | |
| 2010/0187924 | A1 | 7/2010 | Yagai et al. | |
| 2011/0297474 | A1 | 12/2011 | Aono et al. | |
| 2012/0093668 | A1 | 4/2012 | Gieras et al. | |
| 2020/0350791 | A1 | 11/2020 | Le et al. | |
| 2022/0097816 | A1 | 3/2022 | Nakev | |
| 2023/0074750 | A1 | 3/2023 | Muller | |
| 2023/0084989 | A1 | 3/2023 | Bruneau et al. | |

OTHER PUBLICATIONS

International Search Report and Written Opinion of the ISA/US, mailed Jul. 10, 2024, in connection with International Application No. PCT/US2024/024623.

International Search Report and Written Opinion of the ISA/US, mailed Jul. 17, 2024, re International Application No. PCT/US2024/026613.

Interplex; Realize new EV possibilities with our Motor Stator Busbar Innovation; Aug. 29, 2023.

Masoumi et al.; Manufacturing Techniques for Electric Motor Coils with Round Copper Wires; IEEE Access; vol. 10; pp. 130212-130223; Dec. 20, 2022.

Product Focus: Interplex Showcases Latest Motor Stator Busbar for EV Motors; Battery & Electrification Insider; Sep. 13, 2023.

Roulier et al.; Innovative Solutions to Connect Stator Main Windings in Rotating Machines via Circular Laminated Bus Bars; Power Electronics Note 4.

* cited by examiner

JET PUMP PROPULSION SYSTEM

CROSS REFERENCE TO RELATED APPLICATIONS

This application is a continuation of International Application No. PCT/US2024/026613, filed Apr. 26, 2024, which claims the benefit of the filing date of U.S. provisional patent application Ser. No. 63/462,289, filed on Apr. 27, 2023, entitled "JET PUMP PROPULSION SYSTEM," the disclosures of which are incorporated herein by reference for all purposes.

TECHNICAL FIELD

The invention relates in general to powered watercraft, and in particular to jet pump propulsion systems and components.

BACKGROUND

In the last few years, there has been increased use of waterjet systems for commercial and recreational applications. The marine propulsors used in these systems show remarkable qualities in terms of energy consumption, noise, and vibrations. However, they have some disadvantages which make their use optimal only for a limited speed range and which limit the overall propulsive efficiency. Thus, there is a need to modify a conventional waterjet with the aim of reducing these problems and increasing the overall efficiency of the propulsion system.

SUMMARY

In response to these and other problems, in one embodiment, there is a jet pump system comprising inlet component, an electronic controller which is cooled via the inflow of water through the inlet component, a combined motor impeller system positioned adjacent to the outflow aperture of the inlet component, and a nozzle pump positioned adjacent to the outflow of the motor impeller system.

In other embodiments, there may be a marine propulsion system comprising: an inlet conduit, including an inlet opening and an outlet opening, an electronic controller thermally coupled to the inlet conduit, an impeller positioned downstream relative to the outlet opening of the inlet conduit, the impeller including at least one impeller blade and a cylindrical outer shell coupled to the at least one impeller blade; an electric motor coupled to the cylindrical outer shell of the impeller; and a nozzle positioned downstream relative to the impeller.

In yet other embodiments, a least a portion of the electric motor above is positioned in a concentric manner relative to the cylindrical outer shell of the impeller.

In yet other embodiments, the electric motor comprises a stator and a rotor yoke, and the rotor yoke is physically coupled to the cylindrical outer shell of the impeller such that when the rotor yoke rotates, the cylindrical outer shell follows.

In yet other embodiments, the electric motor comprises a stator and a rotor yoke, and the rotor yoke is physically coupled to the cylindrical outer shell such that the cylindrical outer shell provides structural support for the rotor yoke.

Other embodiments include: a first structure defining a plurality of inlet apertures positioned downstream of the impeller; a second structure defining a plurality of outlet apertures positioned upstream of the impeller; and at least one void hydraulically coupling the plurality of inlet apertures to the plurality of outlet apertures.

Other embodiments include an exterior sleeve positioned around at least part of the electric motor which creates the void between a stator and the exterior sleeve.

Other embodiments include: a non-rotating stabilizing shaft positioned within the impeller.

Other embodiments include: a stabilizing inlet structure coupled to the non-rotating stabilizing shaft.

Other embodiments include: a plurality of de-swirling vanes positioned downstream of the impeller.

Other embodiments include: a vane guide positioned downstream from the impeller and upstream of the nozzle, the vane guide having at least a portion of the de-swirling vanes.

Other embodiments include the above and a cone having a threaded upstream end for mating with the vane guide and a pointed downstream end, the cone having a plurality of longitudinal slots for engaging a torque inducing instrument.

Other embodiments include an enclosure for housing the electronic controller that is integral with the inlet conduit.

Other embodiments include an enclosure for housing the electronic controller that is separate from the inlet conduit, but thermally coupled to the inlet conduit.

In yet other embodiments, the electronic controller is an electronic speed controller.

In yet other embodiments, the electronic controller includes heat generating components attached to the inlet conduit.

In yet other embodiments, the heat generating components attached to the inlet conduit are MOSFETS.

In some embodiments, there may be a method of cooling components of a water craft, the method comprising: thermally coupling heat generating components of an electronic controller to an inlet conduit, causing a fluid flow through the inlet conduit by rotating an impeller hydraulically coupled to the inlet conduit wherein the impeller has an inlet side and an outlet side; generating heat within the heat generating components of the electronic controller; transferring a portion of the heat generated by the heat generating components to the inlet conduit; and transferring a portion of the heat from the inlet conduit to the fluid flow such that the electronic components of the electronic controller are cooled; extracting a portion of the fluid from the fluid flow on an outlet side of the impeller; causing the extracted fluid to flow past an electric motor coupled to the impeller to transfer heat from the electric motor to the extracted fluid; and recirculating the heated extracted fluid back into the fluid flow on the inlet side of the impeller.

In some embodiments, there may be a method of cooling an electronic controller of a water craft, the method comprising: thermally coupling heat generating components of the electronic controller to an inlet conduit, causing water to flow through the inlet conduit; generating heat within heat generating components of the electronic controller; transferring a portion of the heat generated by the heat generating components to the inlet conduit; and transferring a portion of the heat from the inlet conduct to water flowing through the inlet conduit such that the electronic components of the electronic controller are cooled by the above transferring steps.

Other embodiments include the methods above, wherein the generating heat with heat generating components includes changing the rotational speed of a motor coupled to the water craft.

Other embodiments include the methods above, wherein the transferring a portion of the heat generated by the heat generating components to the inlet conduit includes transferring a portion of the heat generated by the heat generating components to a thermally conductive plate embedded in the inlet conduit.

Other embodiments include the methods above, wherein the transferring a portion of the heat generated by the heat generating components to the inlet conduit includes thermally coupling the heat generating components directly to the inlet conduit.

These and other features, and advantages, will be more clearly understood from the following detailed description taken in conjunction with the accompanying drawings. It is important to note the drawings are not intended to represent the only aspect of the invention.

DETAILED DESCRIPTION

Figure 1A:
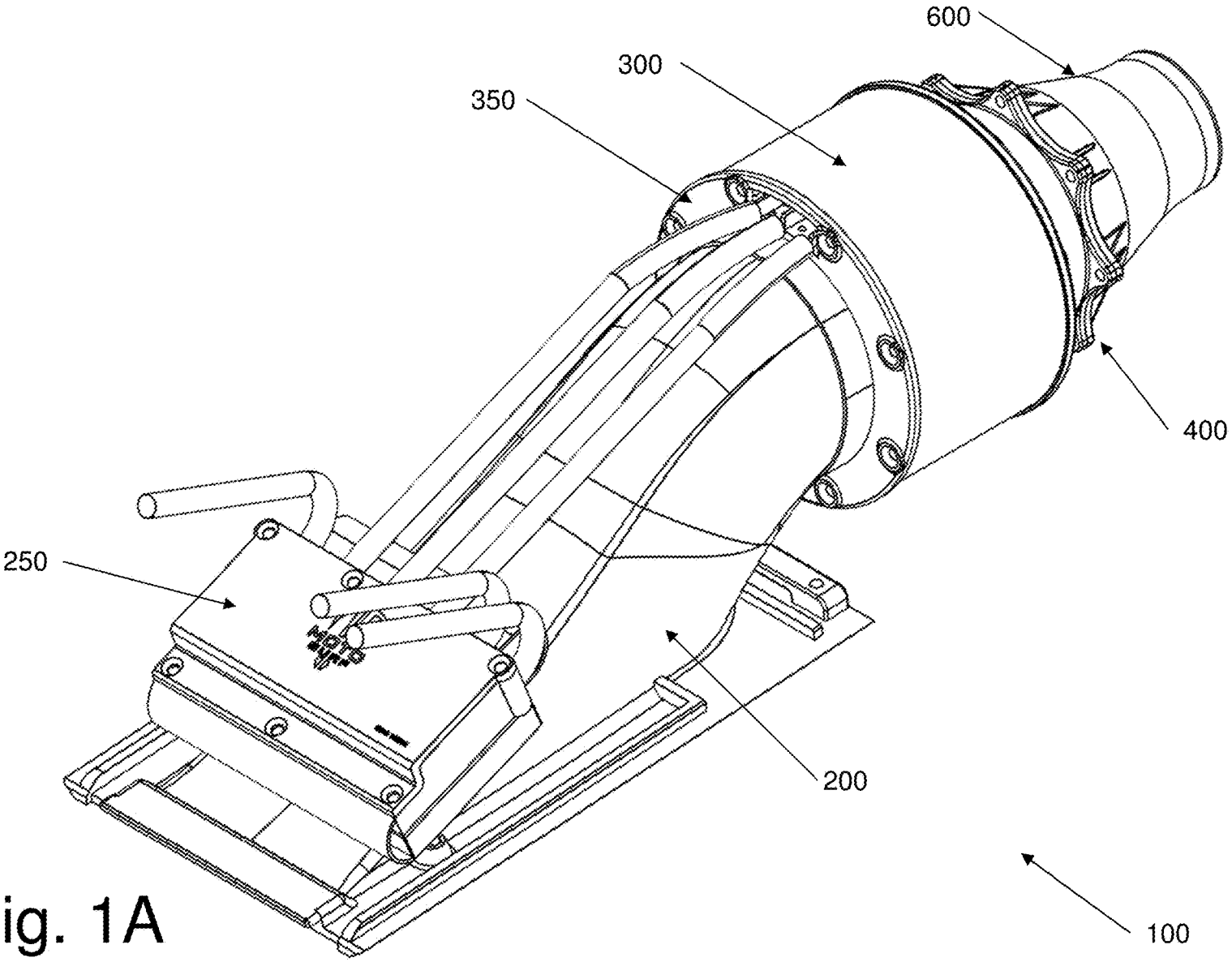
FIG. 1A is an isometric top view illustrating one embodiment of watercraft propulsion system looking from the front or inlet perspective which incorporates one or more aspects of the present invention.

For the purposes of promoting an understanding of the principles of the present inventions, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the inventions as described herein are contemplated as would normally occur to one skilled in the art to which the invention relates.

Well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

When directions, such as front, rear, upper, lower, top, bottom, clockwise, counter-clockwise, are discussed in this disclosure, such directions are meant to only supply reference directions for the illustrated figures and for orientation of components in respect to each other or to illustrate the figures. The directions should not be read to imply actual directions used in any resulting invention or actual use. Under no circumstances, should such directions be read to limit or impart any meaning into the claims.

In this application, the phrase longitudinal or axial direction means the direction along or parallel to the component's longitudinal or axial axis. The phrase radial direction refers to the direction along a radius from the longitudinal axis and extending outwardly. The phrase circumferential refers to a direction along a circumference of a circle or circular rotation about the longitudinal or axial axis. Furthermore, the term "downstream" means positioned later or further down in the fluid flow. In contrast, the term "upstream" means positioned earlier in the fluid flow.

Figure 1B:
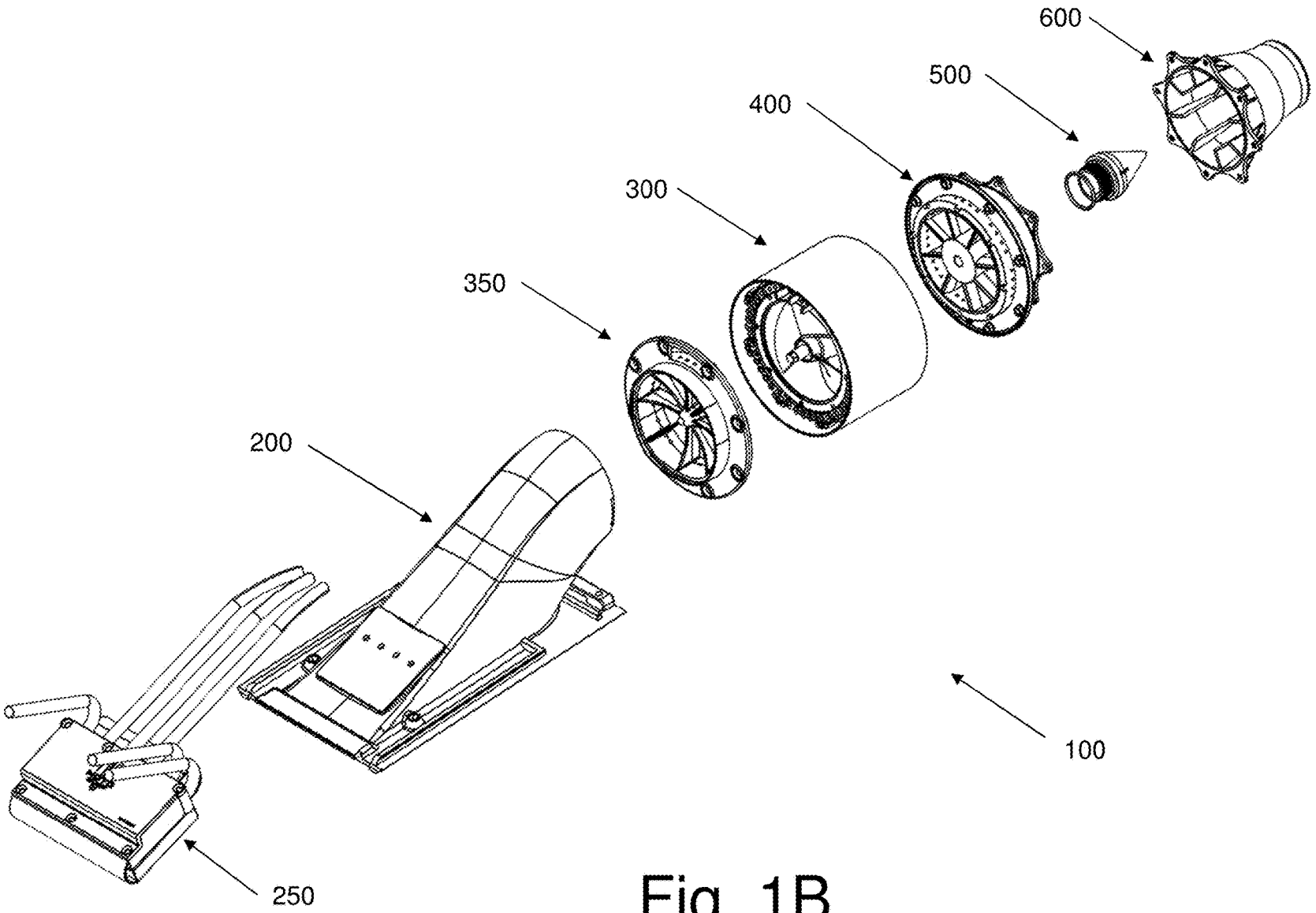
FIG. 1B is an isometric exploded view illustrating the main components of the watercraft propulsion system of FIG. 1A.
Figure 1C:
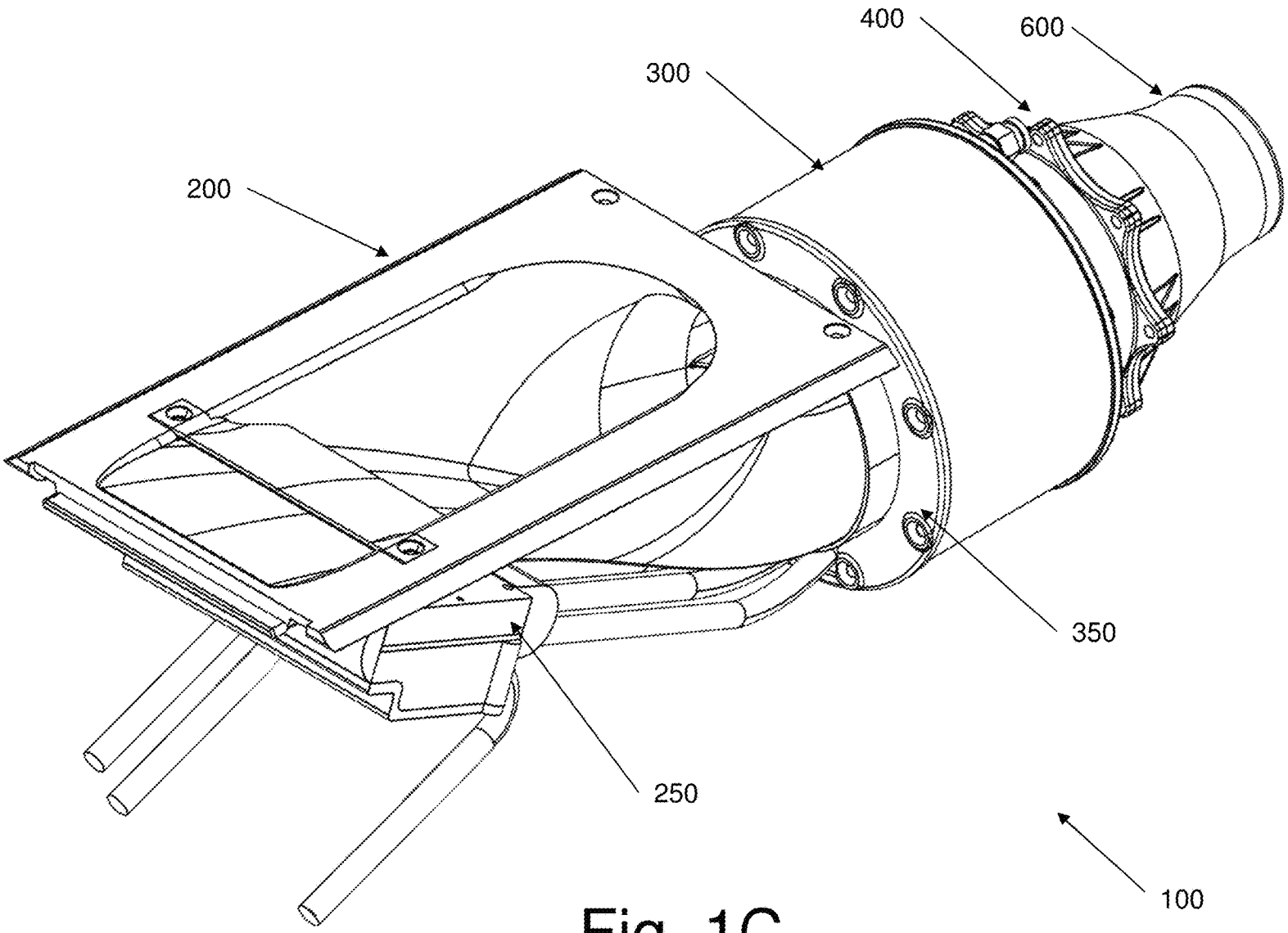
FIG. 1C is an isometric bottom view of the watercraft propulsion system of FIG. 1A.
Figure 1D:
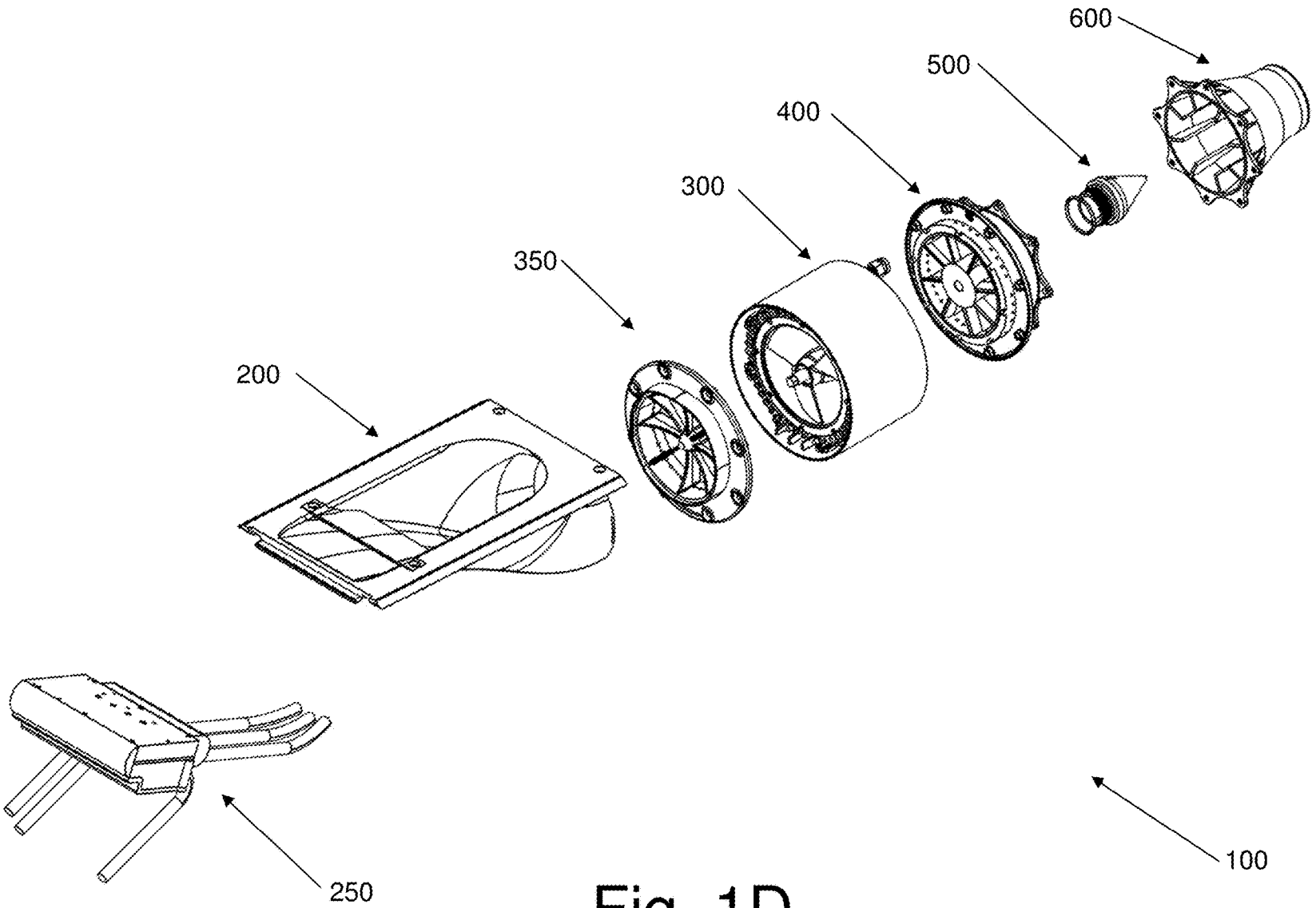
FIG. 1D is an isometric exploded view of the watercraft propulsion system of FIG. 1C.

FIG. 1A is an isometric top view illustrating one embodiment of watercraft propulsion or jet pump system 100 looking from the inlet side of the system. FIG. 1B is an exploded isometric view of the pump system 100 illustrated in FIG. 1A illustrating some of the major components. In contrast, FIG. 1C is an isometric bottom view of the jet pump system 100 also looking from the inlet side of the system. FIG. 1D is an exploded view of the pump system 100 illustrated in FIG. 1C.

Turning now to FIGS. 1A, 1B, 1C, and 1D in certain embodiments, the pump system's 100 main components comprise an inlet component 200, an electronic controller or electronic speed controller 250, an impeller stabilizer 350 positioned downstream of the inlet component, a motor-impeller component 300 positioned downstream of the impeller stabilizer, a vane guide 400 positioned downstream of the motor-impeller, a discharge cone 500, and a nozzle or nozzle pump 600 positioned downstream of the vane guide.

Figure 2A:
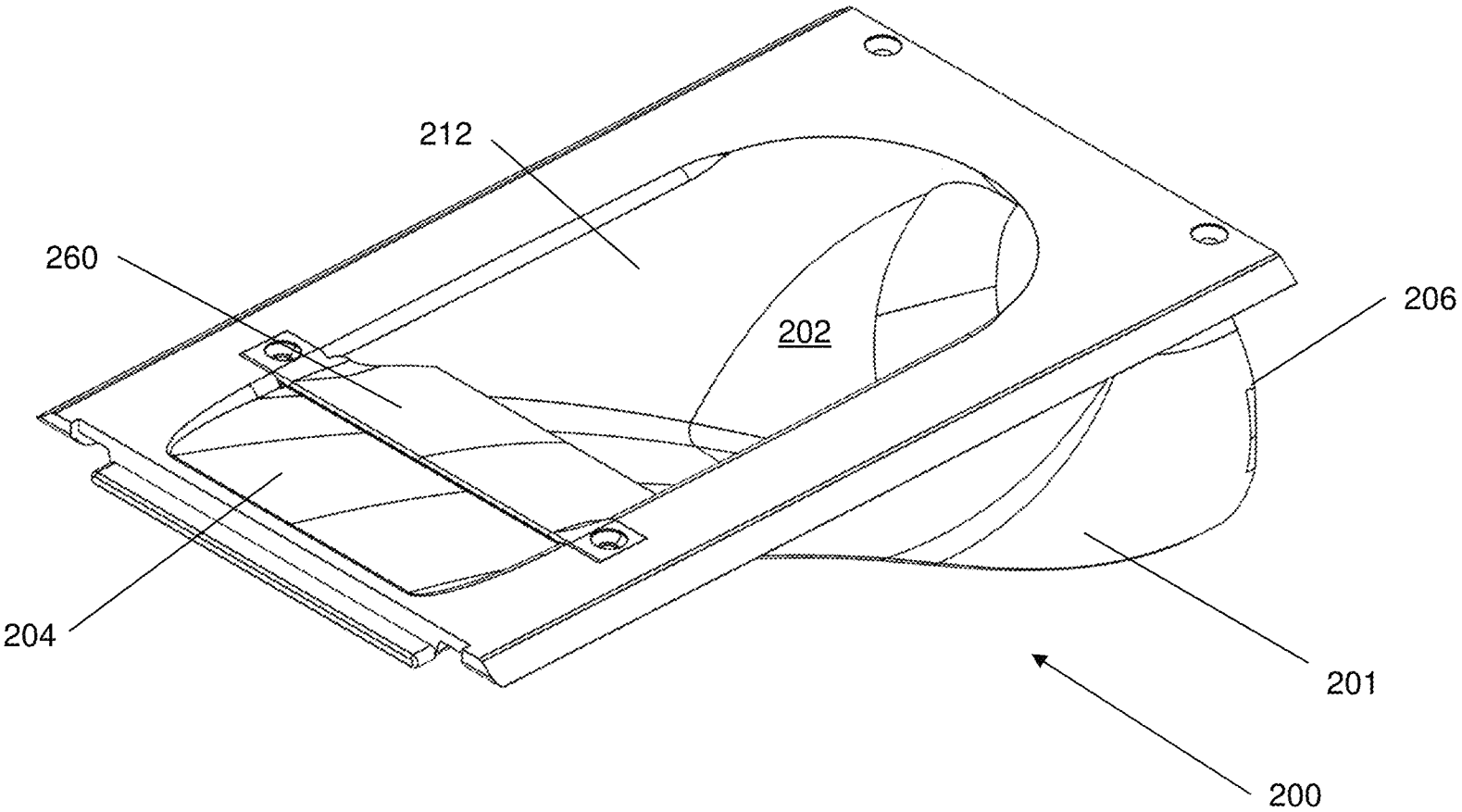
FIG. 2A is a bottom isometric view illustrating one embodiment of the inlet component which may be used in various embodiments.
Figure 2B:
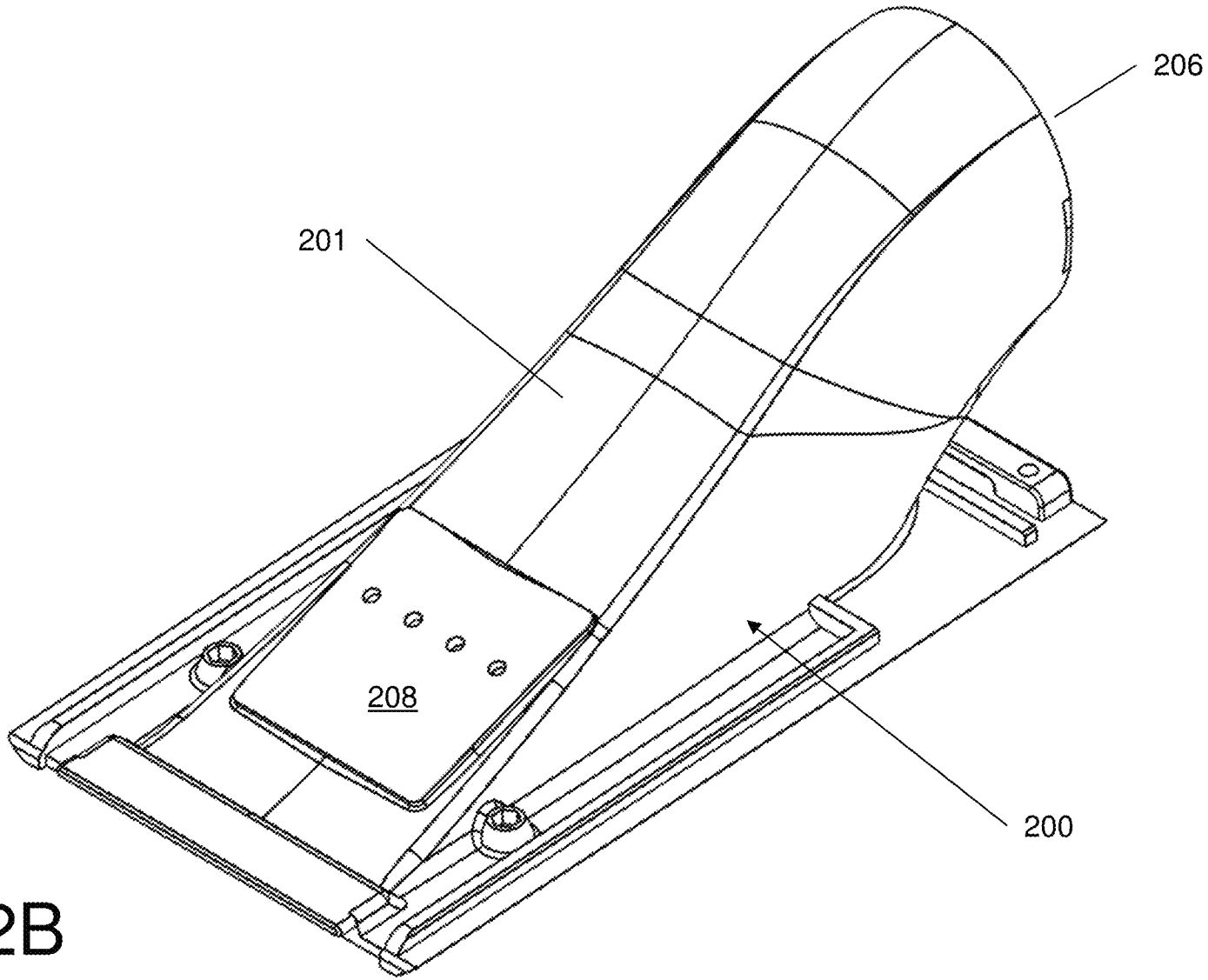
FIG. 2B is a top isometric view illustrating one embodiment of the inlet component of FIG. 2A.
Figure 2C:
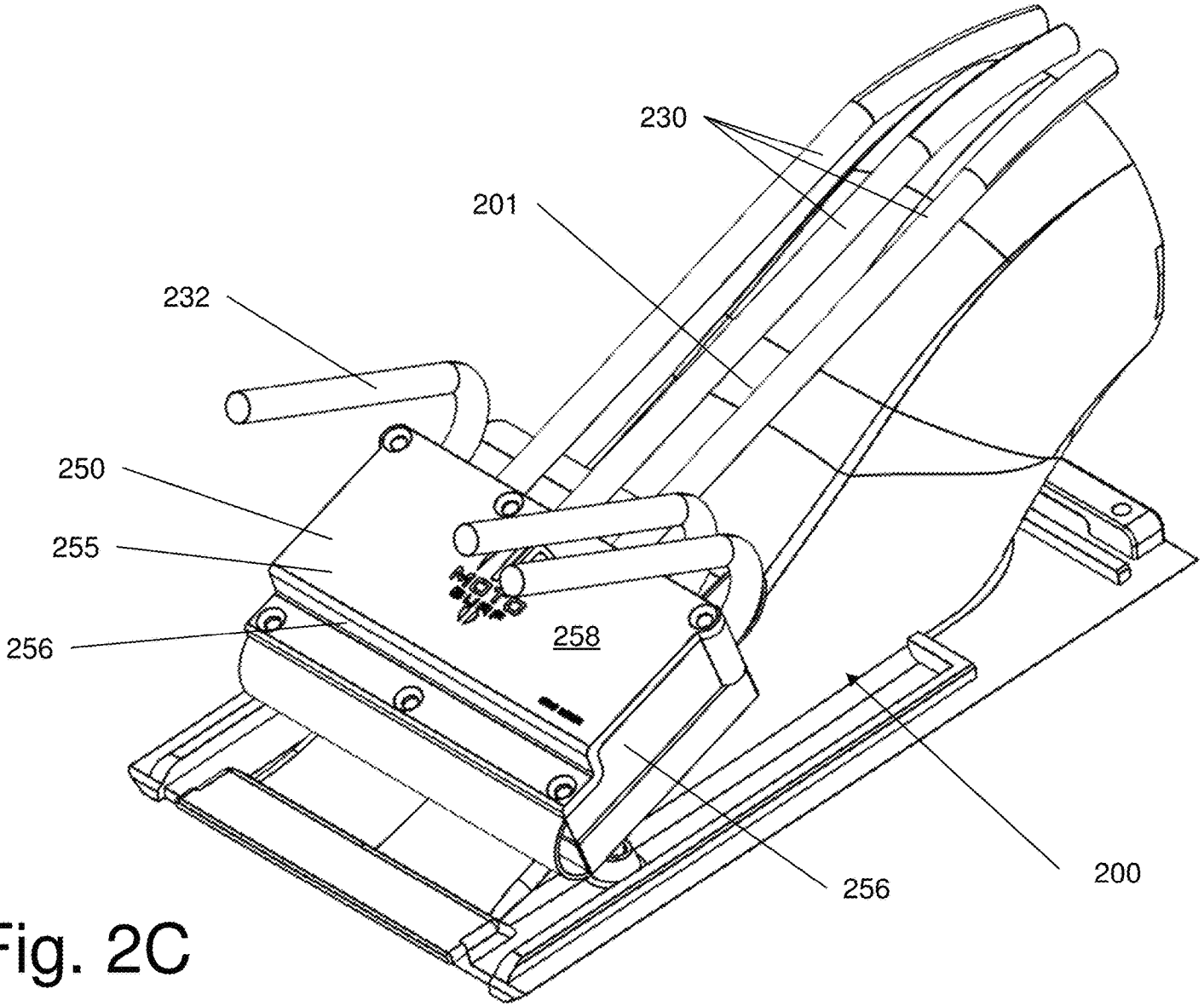
FIG. 2C is a top isometric view illustrating one embodiment of the inlet component and an electronic speed controller coupled to the inlet component.
Figure 3:
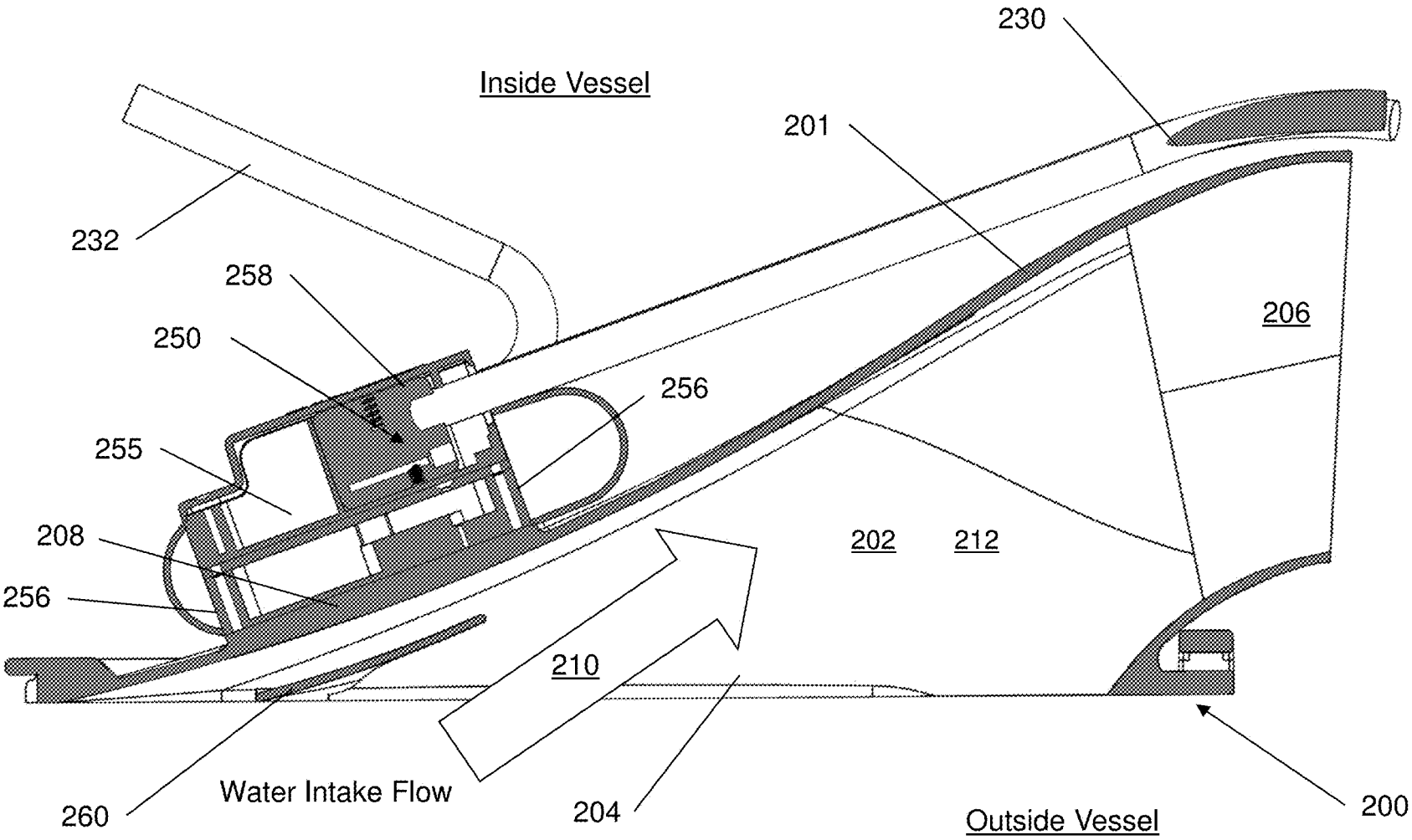
FIG. 3 is a section view illustrating one embodiment of the inlet component and an electronic speed controller coupled to the inlet component.

FIG. 2A is an isometric bottom view illustrating one embodiment of the inlet component 200 which may be incorporated into the jet pump system 100. In contrast, FIG. 2B is an isometric top view illustrating the inlet component 200. FIG. 2C is an isometric top view illustrating the inlet component 200 physically coupled to the electric controller 250. FIG. 3 is a section view showing the electric controller 250 physically coupled to the inlet component 200.

Turning now to FIGS. 2A, 2B, 2C, and 3, the inlet component 200 comprises a main or inlet conduit 201 which defines a water inlet tunnel 202 allowing the motor-impeller component 300 to suck water into the impeller when in use. In certain embodiments, the inlet tunnel 202 also defines an inlet mouth 204 and an outlet or discharge opening 206. In certain embodiments, a mounting surface or platform 208 may be formed on one exterior face of the main conduit 201. In the illustrated example, the mounting surface 208 is formed on a top surface of the main conduit (see FIG. 2B). In certain embodiments, the mounting surface 208 is a flat contact surface positioned on the inside of the vessel or watercraft as illustrated in FIG. 3. The electronic controller or electronic speed controller 250 may be positioned on the mounting surface 208 which is positioned on the inside (or in a relatively dry space) of the vessel or watercraft. In certain embodiments, the electronic controller 250 is waterproofed and/or uses water proof electrical wiring and connections as is known in the art. As illustrated in FIGS. 2C and 3, the electronic controller 250 is coupled to water electrical wires 230 and 232 (only part of the wires are illustrated in FIGS. 2C and 3). In certain embodiments, waterproof electrical and/or power wires 230 run from the electronic controller 250 to electrical connections (not shown) of the motor-impeller unit 300. Additionally, waterproof electrical and/or power wires 232 may run from a main controller and/or battery (not shown) to the electronic controller 250.

In certain embodiments, the electronic controller 250 is designed so that the heat generating components (e.g., metal oxide semiconductor field effect transistors, "MOSFETS") are spread out to increase the area of contact with the mounting surface 208 to allow a greater heat transfer from the controller to the mounting surface. Thus, in certain embodiments, the entirety of the inlet component 200 extracts heat from the electronic controller 250 and becomes a heat sink for the various components and MOSFETS of the electronic controller.

During operation of the watercraft, water enters the mouth 204 of the inlet tunnel 202 in the general direction indicated by arrow 210, the water flows through the tunnel and makes contact with inner surfaces 212 of the inlet component and heat is transferred to the flowing water through physical contact with the inner surfaces. Therefore, the water flowing through the inlet tunnel 202 becomes a cooling system for the electronic controller 250. In certain embodiments, the MOSFETS and other heat generating components may be directly connected to the inlet component 200, which is made from a heat conducting material—such as aluminum.

In some embodiments, a mounting surface 208 allows the electronic controller 250 to be coupled to the main conduit 201 as illustrated in FIGS. 2C and 3. Heat is generated by the electronic controller 250 is conducted to the mounting surface 208 and spreads to other portions of the main conduit 201 in embodiments where the mounting platform 208 is homogenous with the main conduit 201.

As discussed above, in certain embodiments, the inlet component 200 may be homogenous and formed of aluminum or another heat conducting material. Thus, the entire inlet component (or much of the inlet component) may become a heat sink for the electronic controller 250. In other embodiments, the inlet component 200 may be formed of plastic or fiberglass and have a heat conducting platform or plate embedded in the inlet component. In such embodiments, most of the heat transfer occurs between the embedded conducting plate and the flowing water.

Yet in other embodiments, an electronic controller enclosure or compartment 255 may be formed and may be integral with the inlet component 200. In such an embodiment, a plurality of walls 256 may extend outward from the mounting surface 208 to form an enclosure 255 comprising, for instance, four upward extending walls and a bottom surface which is the mounting surface 208. In such an embodiment, a top plate 258 may couple to the walls to seal the enclosure. In certain embodiments, the perimeter mating surfaces of the top plate and the walls 256 may form one or more steps (not shown) to accommodate a waterproof seal, such as a silicone seal. In certain embodiments, the entire enclosure may be encased in epoxy or an appropriate potting compound.

In yet other embodiments, an embedded platform or heat transfer plate may be positioned in other places along a submersible portion of the hull of the watercraft or vessel (not shown). Thus, the electronic controller may be positioned on the interior side of the submersed hull next to a heat transfer platform embedded in the hull. For instance, the hull could be made of fiberglass, carbon fiber, or wood, but have an embedded plate made of aluminum or another heat conducting metal. The electric controller may then be positioned directly adjacent to the embedded platform so that the embedded platform becomes a heat sink for the electronic controller. Flowing water (relative to the hull) on the external side of the hull cools the heat sink which also results in a cooling of the electronic controller. Consequently, aspects of the invention may be used in any situation where electric motors and/or pump jets are used with vessels and other forms of watercraft.

Turning back to FIG. 2A, in certain embodiments there may be an inlet flow plate 260 which may separate high speed flow from low-speed flow going through the intake mouth 204. In certain embodiments, the inlet flow plate 260 creates a low-pressure zone of flow that creates a barrier of water (i.e., a zone of lubricity) for the high-speed flow so the high speed flow does not encounter resistance due encountering stationary walls of the inlet conduit 201. Furthermore, in use, an inlet flow plate 260 may help keep the board "sucked" down to keep enough flow of water going through the inlet tunnel 202 at high speed on straights.

Figure 4B:
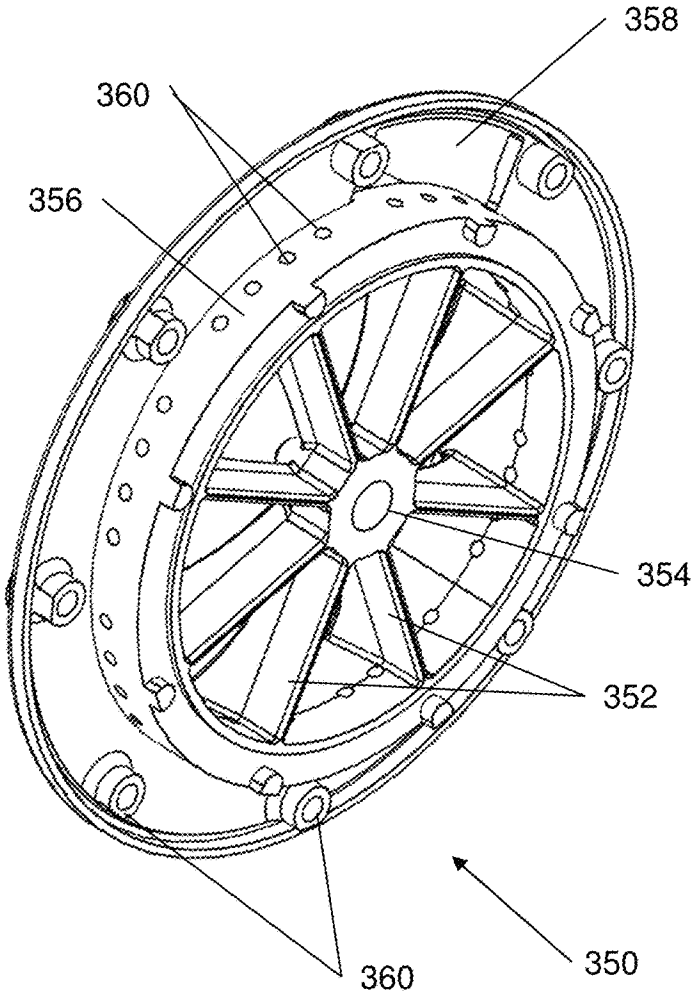
FIG. 4B is a rear or back perspective view of the inlet stabilizer of FIG. 4A.
Figure 4A:
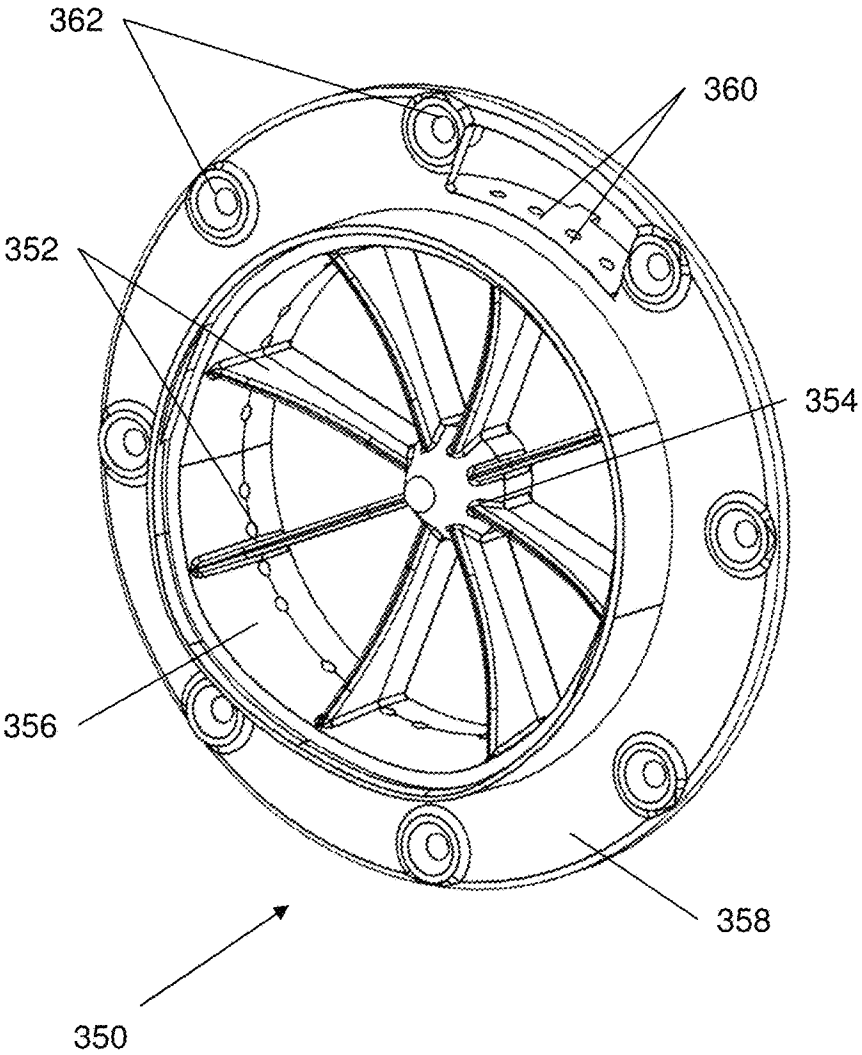
FIG. 4A is a front perspective view of an inlet stabilizer for a motor.

In certain embodiments, an impeller stabilizer 350 couples the outlet portion of the inlet component 200 to the motor-impeller component 300. FIG. 4A illustrates one embodiment of the impeller stabilizer 350 illustrated from the inlet perspective (facing the discharge opening 206). In contrast, FIG. 4B illustrates one embodiment of the impeller stabilizer 350 from the outlet perspective (facing the motor-impeller component 300). In certain embodiments, the impeller stabilizer 350 provides stabilization for a stabilizing shaft 308 (See FIG. 5A) of the motor-impeller component 300, and is either designed to reduce the amount of hydrodynamic and/or aerodynamic drag on the intake side of the motor-impeller component. In certain embodiments, a plurality of radially spaced vanes 352 connect a center hub 354 to a stabilizing rim 356 which is coupled to an outer mounting ring 358. The shape of center hub 354 is designed to reduce the amount of hydrodynamic drag on the intake side of the motor-impeller component 300.

The mounting ring 358 defines a plurality of circumferentially spaced apertures 362 for connectors, such as screws (not shown) to couple the stabilizer 350 to the motor-impeller component 300. The stabilization vanes 352 provide support to the center hub 354 and also help control and stabilize the water flow before it reaches the impeller of the motor-impeller component 300. In certain embodiments, a plurality of outlet ports 360 are defined within the stabilizing rim 356. As will be explained later, the outlet ports 360 allow heated water from the motor-impeller 300 until to be injected back into the main water flow entering the motor-impeller.

Figure 5B:
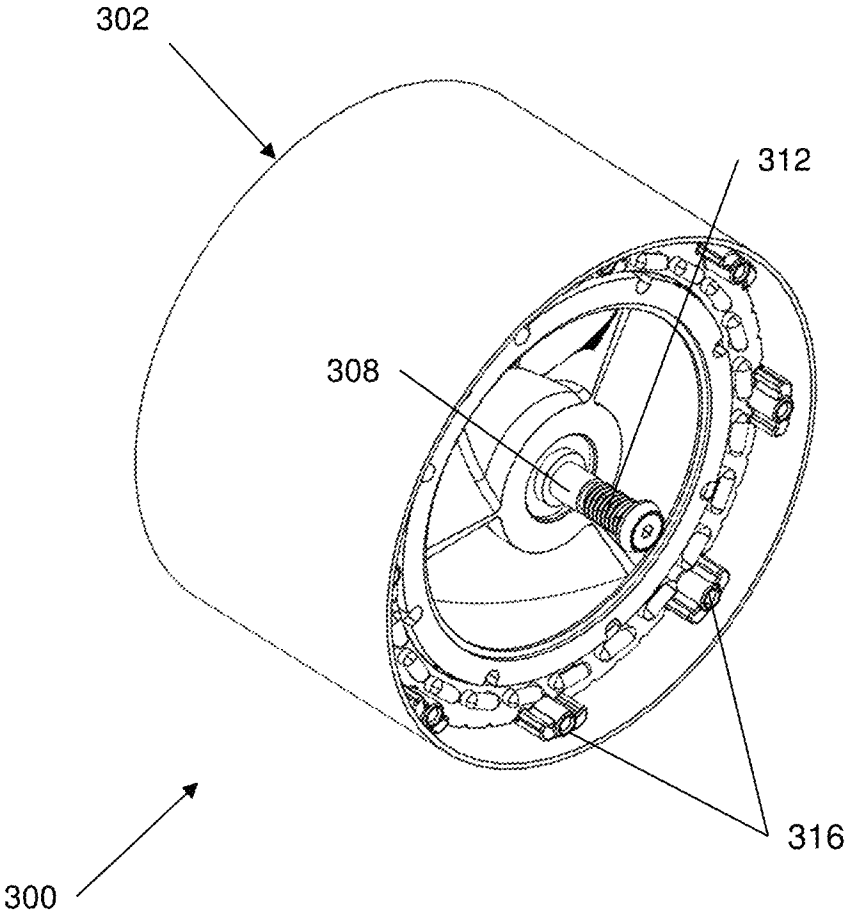
FIG. 5B is a rear or outflow isometric view of the embodiment of the motor illustrated in FIG. 5A.
Figure 5A:
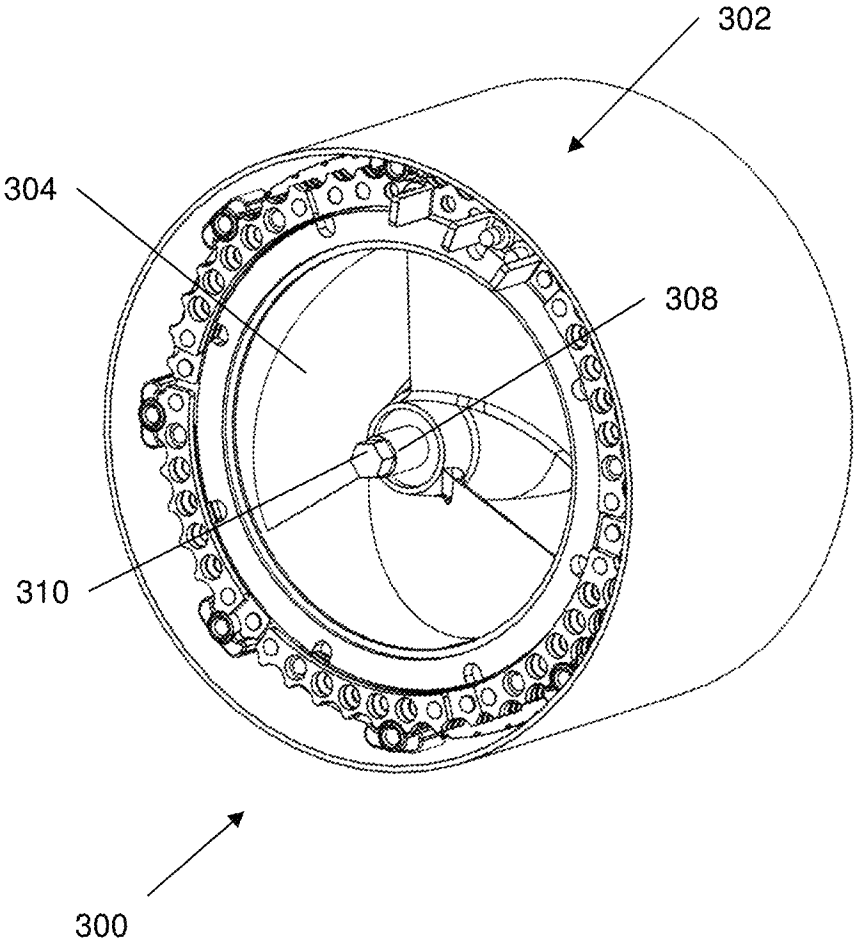
FIG. 5A is a front or inflow isometric view illustrating one embodiment of a motor which may be used with one or more aspects of the watercraft propulsion system of FIGS. 1A-1D

FIG. 5A, is a front or intake perspective view of one embodiment of the electric motor-impeller component 300. FIG. 5B, is a rear or outlet perspective view of one embodiment of the electric motor-impeller component 300.

The electric motor-impeller 300 includes a non-rotating stator (not shown) and a rotating rotor (not shown). A non-magnet impeller 304 is coupled to the rotor or rotor yoke and, therefore, follows as the rotor rotates. A non-rotating center stabilizing shaft 308 reduces vibrations and stabilizes the impeller. The front or inlet end 310 of the non-rotating shaft 308 couples to the center hub 354 of the impeller stabilizer 350 (see FIG. 4B). A rear or outlet end 312 of the non-rotating shaft 308 couples to the vane guide 400 (see FIG. 6A). As illustrated in FIGS. 5A and 5B, a sleeve 302 is shown wrapped around the motor-impeller 300. In certain embodiments, the sleeve 302 may be formed from a thin layer of material, such as carbon fiber. As will be explained below, in certain embodiments, the sleeve 302 creates a void or channel for water to flow through and around the motor-impeller 300. Thus, some of the heat generated from the motor-impeller component 300 can be transferred to the surrounding water via a cylindrical channel created by the space between the sleeve 302 and the motor stator (not shown).

For more information about the motor-impeller component 300, see the Applicant's U.S. Provisional Patent No. 63/459,534, entitled CASELESS ELECTERIC MOTOR WITH A STATIONARY SHAFT; filed on Apr. 14, 2023; U.S. provisional patent application Ser. No. 63/554,831, entitled CASELESS ELECTRIC MOTOR WITH A STATIONARY SHAFT FOR MARINE ENVIROMENTS, filed on Feb. 16, 2024; PCT Application No. PCT/US24/24623, entitled "CASELESS ELECTRIC MOTOR WITH A STATIONARY SHAFT FOR MARINE ENVIROMENTS," filed on Apr. 15, 2024, the disclosures of which are incorporated by reference into this Application for all purposes. The use of the electric motor coupled to and surrounding the impeller 304 eliminates the need for a rotating shaft passing through the inlet tunnel 202—as used with most conventional jet pumps. The elimination of a rotating shaft in the inlet tunnel 202 results a much smoother and predictable water flow through the inlet tunnel 202.

FIG. 5B is a rear or discharge isometric view of the motor-impeller 300 illustrating a portion of a stationary shaft 308 which couples to components of the vane guide 400 and discharge cone 500 to be discussed later in reference to FIG. 6C. A plurality of circumferentially spaced threaded apertures 316 allow a plurality of connectors, such as threaded inserts (not shown) to mechanically couple of the motor-impeller unit to the vane guide 400.

Figure 6B:
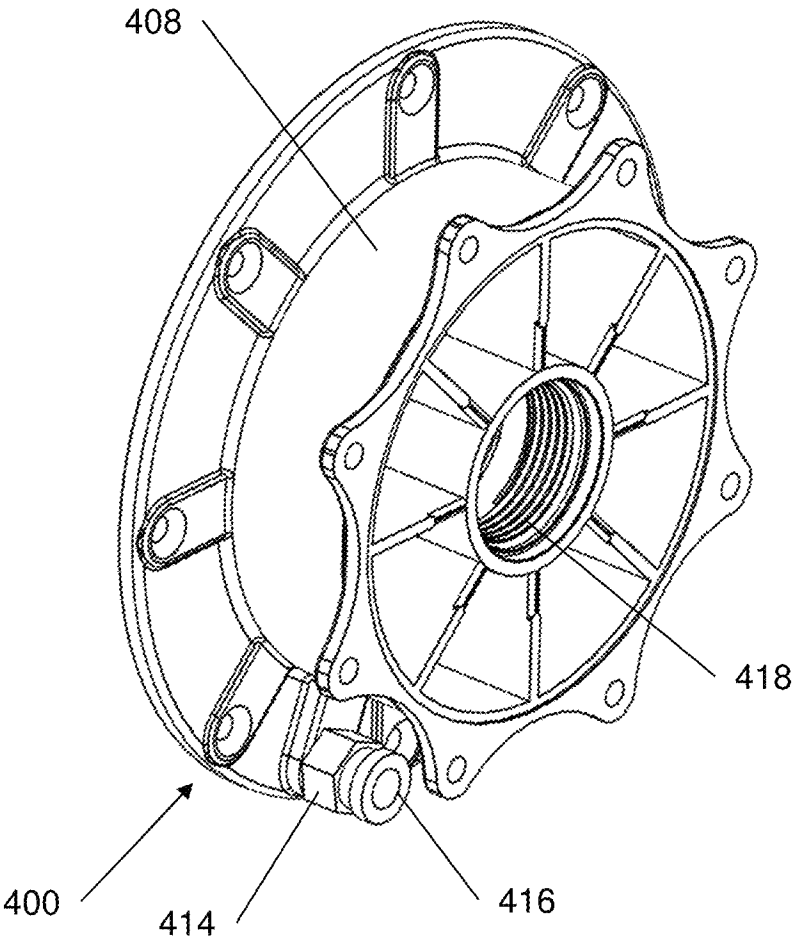
FIG. 6B is a rear or back perspective view of the jet pump housing or vane guide of FIG. 6A.
Figure 6A:
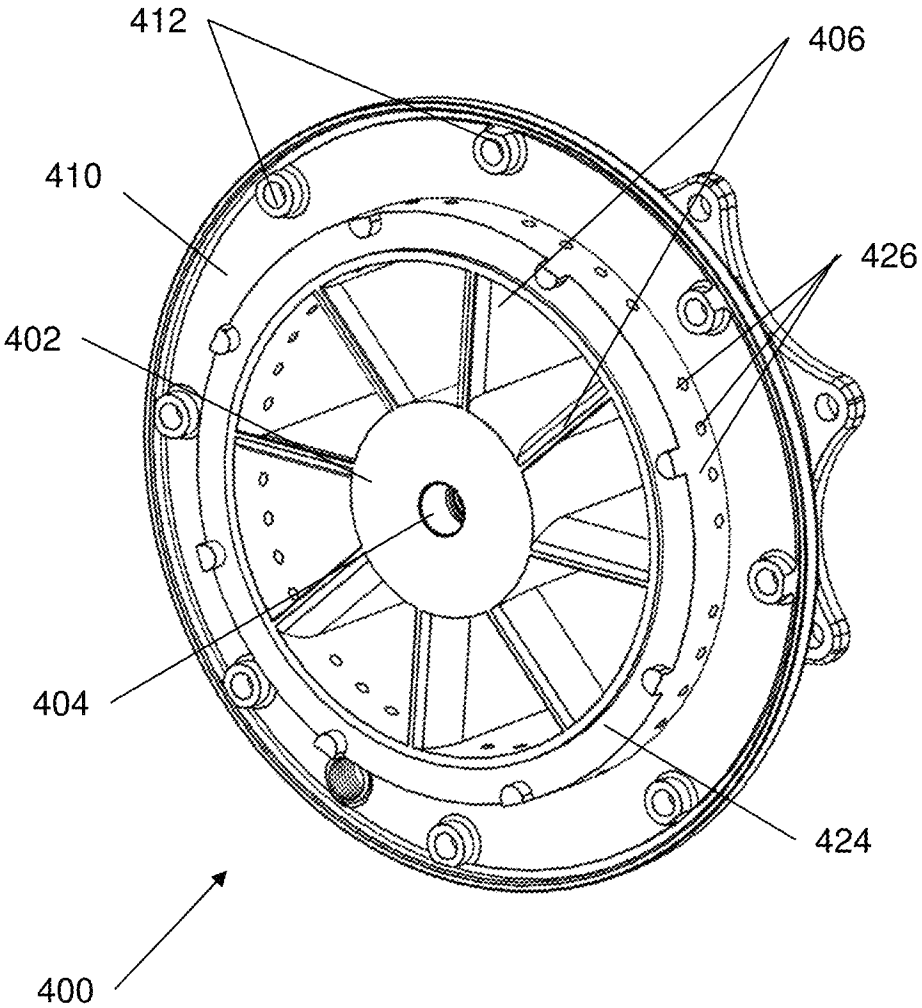
FIG. 6A is a front perspective view of a portion of a jet pump housing or vane guide.

FIG. 6A is a front or intake perspective view illustrating one embodiment the vane guide 400. FIG. 6B is a rear or outlet perspective view of the vane guide 400. FIG. 6C is a exploded perspective view of the vane guide 400 from a rear or discharge view with the addition of the discharge cone 500 and an O-ring 502.

In certain embodiments, the vane guide 400 comprises a center shaft 402 defining a longitudinal bore 404 for accepting the outlet end 312 of the stationary shaft 308 of the motor-impeller component 300 (See FIG. 5B above). In certain embodiments, a portion 413 of the longitudinal bore 404 may be threaded to accept a threaded outlet end 312 of the stationary shaft 308 (see FIG. 8A).

A plurality of de-swirling vanes 406 extending in a radial direction from the center shaft 402 to an exterior cylindrical wall 408 and are designed to minimize the turbulence of the water produced by the impeller 304 (See FIG. 5B). The de-swirling vanes are designed to start de-swirling the flow as soon as practical after being driven by the impeller.

In some embodiments, the inlet face of the vane guide 400 may have an intake mounting flange 410 with a plurality of circumferentially spaced mounting apertures 412 design to receive screws or bolts (not shown) which can be coupled to the threaded insert apertures 316 of the motor-impeller component 300 (See FIG. 5B, above). A motor mounting rim 424 extends in a longitudinal direction towards the motor-impeller 300 and may engage various seals (not shown) of the motor-impeller. One or more pluralities of inlet apertures 426 may be defined around the mounting rim 424 which allow water to injected into the inlet apertures 426 to cool the motor impeller component 300.

In certain embodiments a fitting 414 for a clean-out plug 416 (See FIG. 6B) may be coupled to the intake mounting flange 410 to a allow a user to clean or wash out impurities such as sand and other particulates that may accumulate in the motor-impeller unit during use.

Figure 6C:
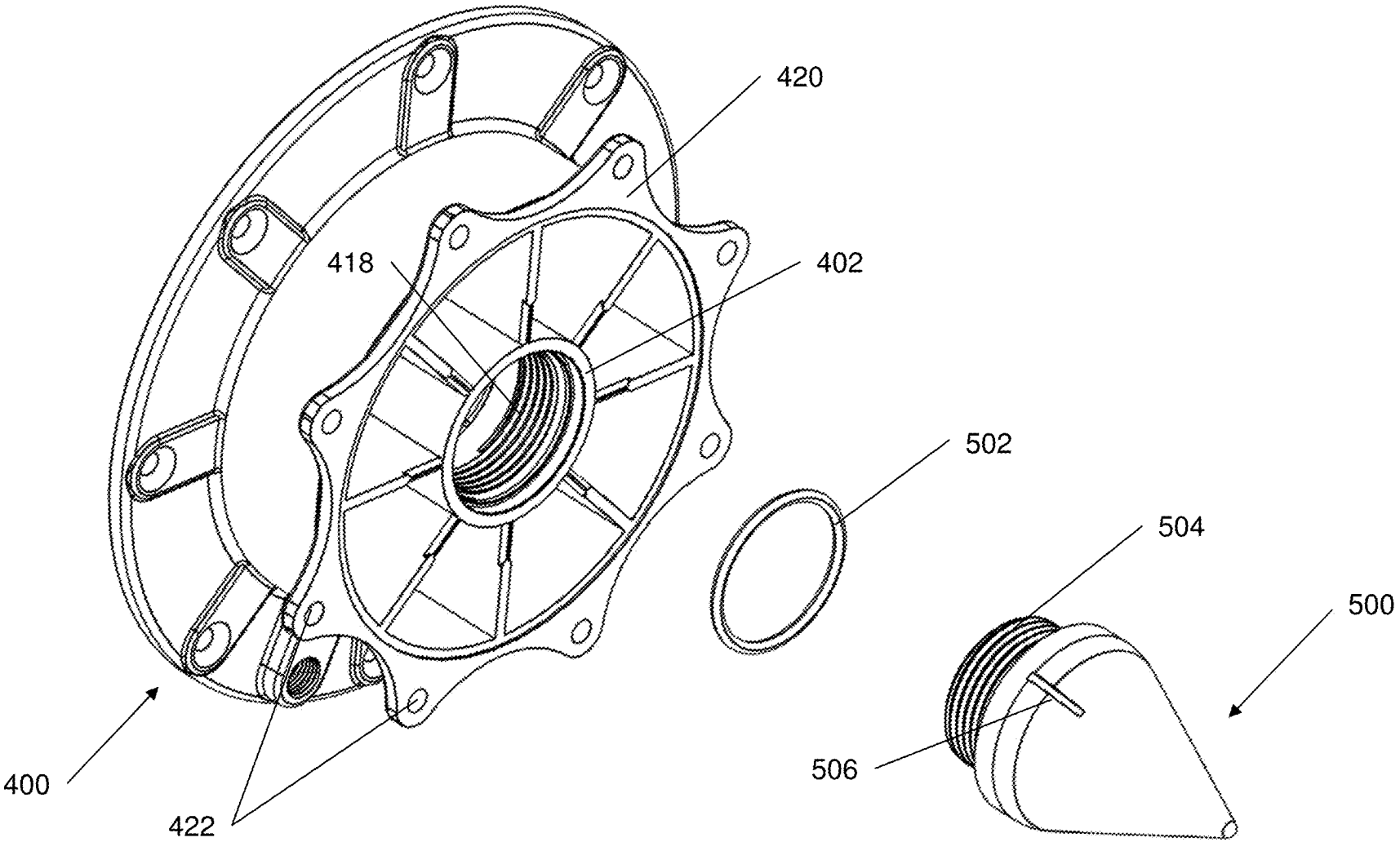
FIG. 6C is a rear or back exploded perspective of the jet pump housing of FIG. 6A with the addition of an outlet center cone.

As illustrated in FIGS. 6B and 6C, the discharge end of the center shaft 402 defines a threaded aperture 418 which is sized and configured to accept a male threaded portion 504 of the nose cone 500. In certain embodiments, an O-ring 502 may be used to seal the nose cone 500 against the center shaft 402.

In certain embodiments, the discharge cone 500 is designed and shaped to reduce the amount of hydrodynamic drag on the discharge side of the impeller. For instance, rather than using a traditional screw slot to mount the discharge cone 500, the discharge cone may be mounted to the center shaft 402 through the use of a specialized tool (not shown) which engage a plurality of linear slots 506 formed on the face of the nose cone to allow a torque to be applied to the nose cone so that the threaded portion 504 of the nose cone can engage the threaded aperture 418 the of the center shaft 402. The linear slots 506 are also designed to reduce the amount of hydrodynamic drag on the discharge cone 500.

Conventional system will use screws and Allen wrenches to attach the impeller which will cause breaks in the water flow and additional surface tension. Such effects are undesirable because they will disturb the overall pressure and speed of the water flow—which causes inefficiencies. Incorporating smooth surfaces, for instance on the discharge cone 500, will reduce hydro-shearing and increase the efficiency of the propulsion system so that the vast majority of the water exiting the discharge end of the nozzle pump is near or at the same speed as the water exiting the motor-impeller unit 300.

At the discharge end of the outer cylinder wall 408, a second or rear mounting flange 420 extends outwardly for supporting a plurality of apertures 422 circumferentially spaced around the flange 420. The apertures 422 are designed to align with another plurality of apertures 602 defined within a mating flange 604 of the nozzle cone or pump 600 as illustrated below in FIGS. 7A and 7B.

Figure 7B:
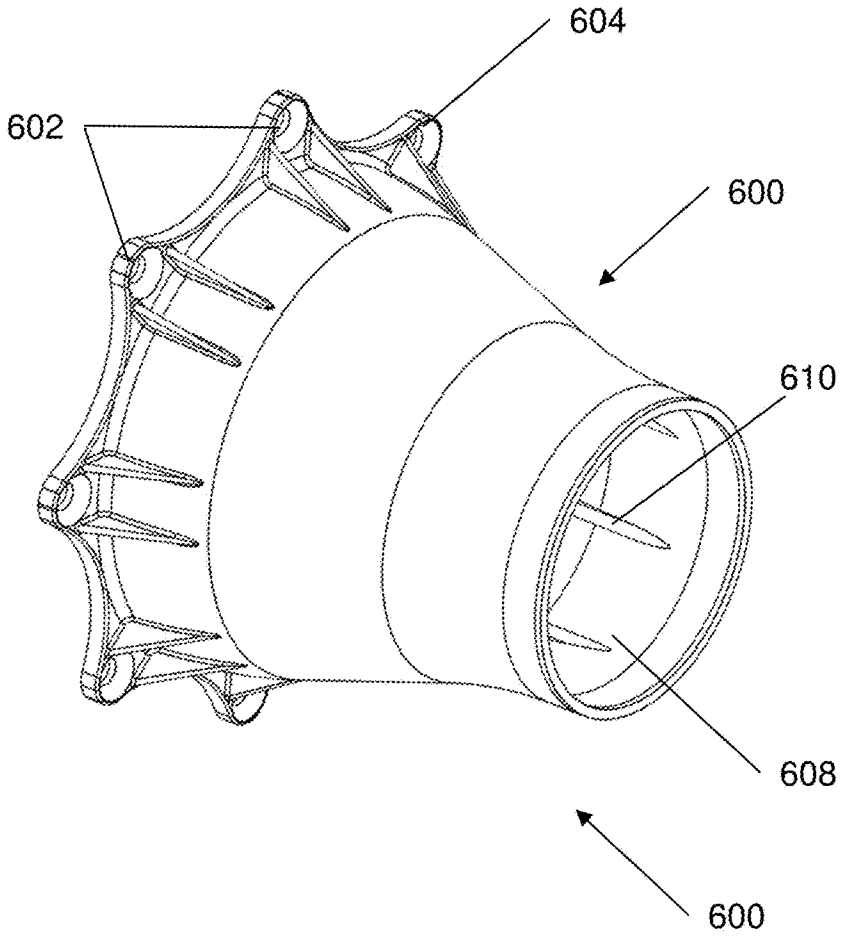
FIG. 7B is a rear or outflow isometric view of the outlet cone illustrated in FIG. 7A.
Figure 7A:
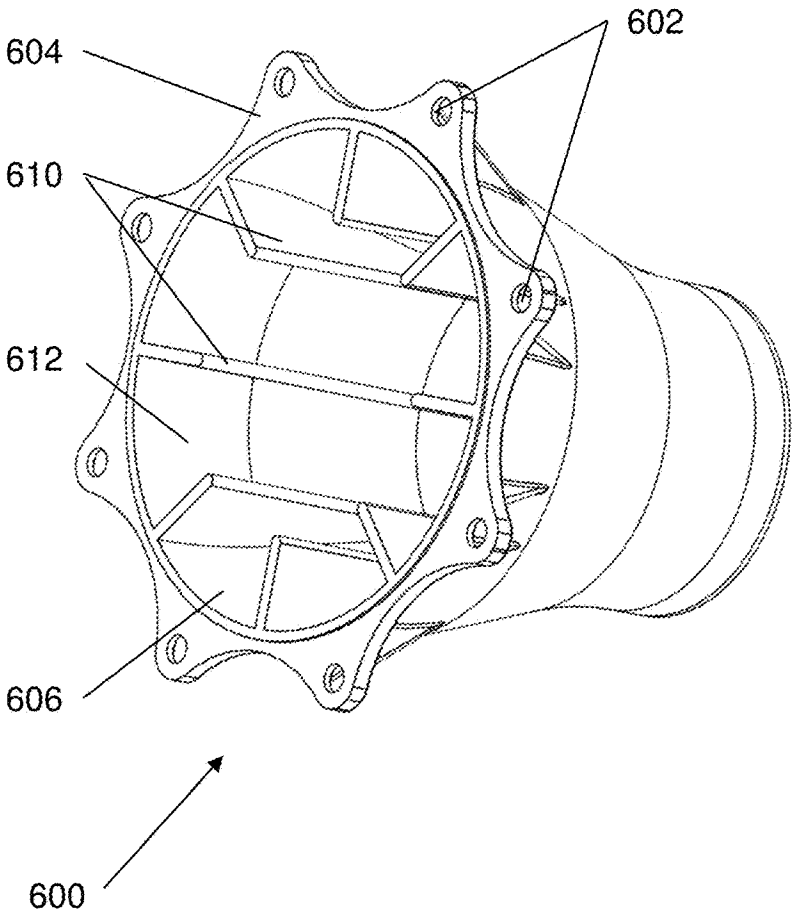
FIG. 7A is a front or inflow perspective view illustrating one embodiment of an outlet cone which may be used with one or more aspects of the watercraft propulsion system of FIGS. 1A through 1D.

FIG. 7A is a front or intake perspective view illustrating one embodiment of the nozzle pump 600. FIG. 7B is a rear or discharge perspective view illustrating the nozzle pump 600. As illustrated, the nozzle pump 600 is generally cone shaped where the inlet or front mouth 606 has a larger diameter than the discharge aperture 608. In certain embodiments, a mounting flange 604 surrounds the inlet mouth 606.

A plurality of circumferentially spaced interior vanes 610 project from an interior surface 612 of the throat of the nozzle pump 600 towards the center or longitudinal axis (not shown) of the nozzle pump 600.

Figure 8B:
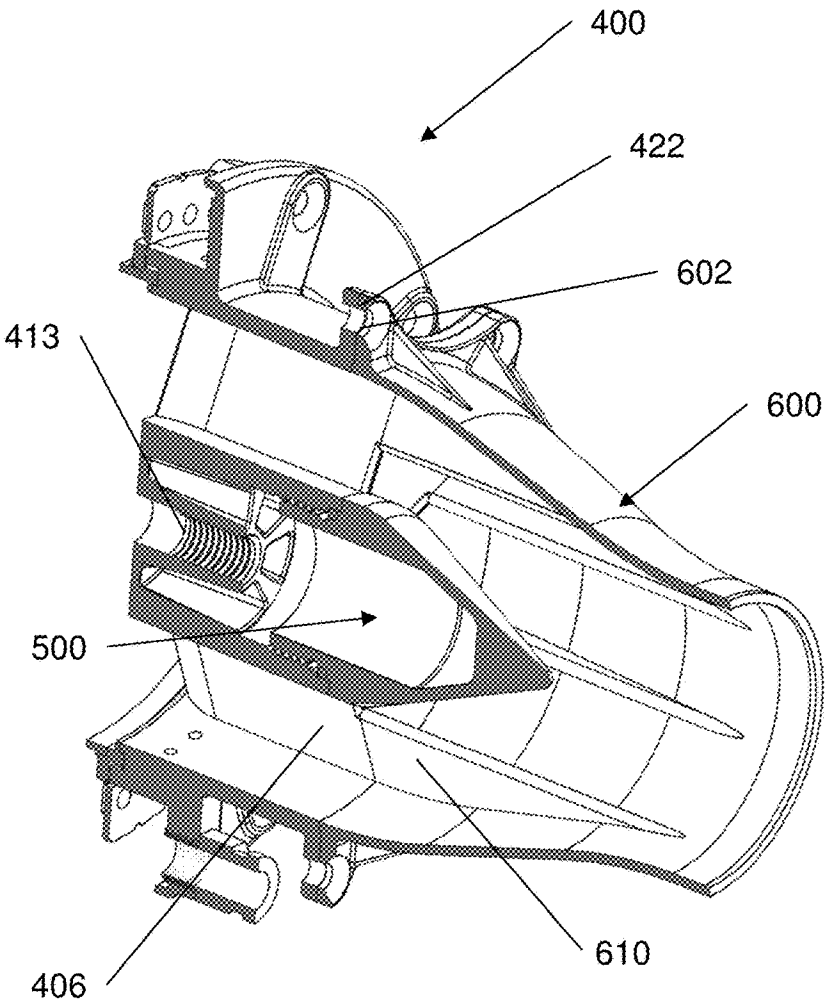
FIG. 8B is an isometric section view from the discharge perspective of the embodiment of the vane guide coupled to the nozzle pump with the addition of a discharge cone.
Figure 8A:
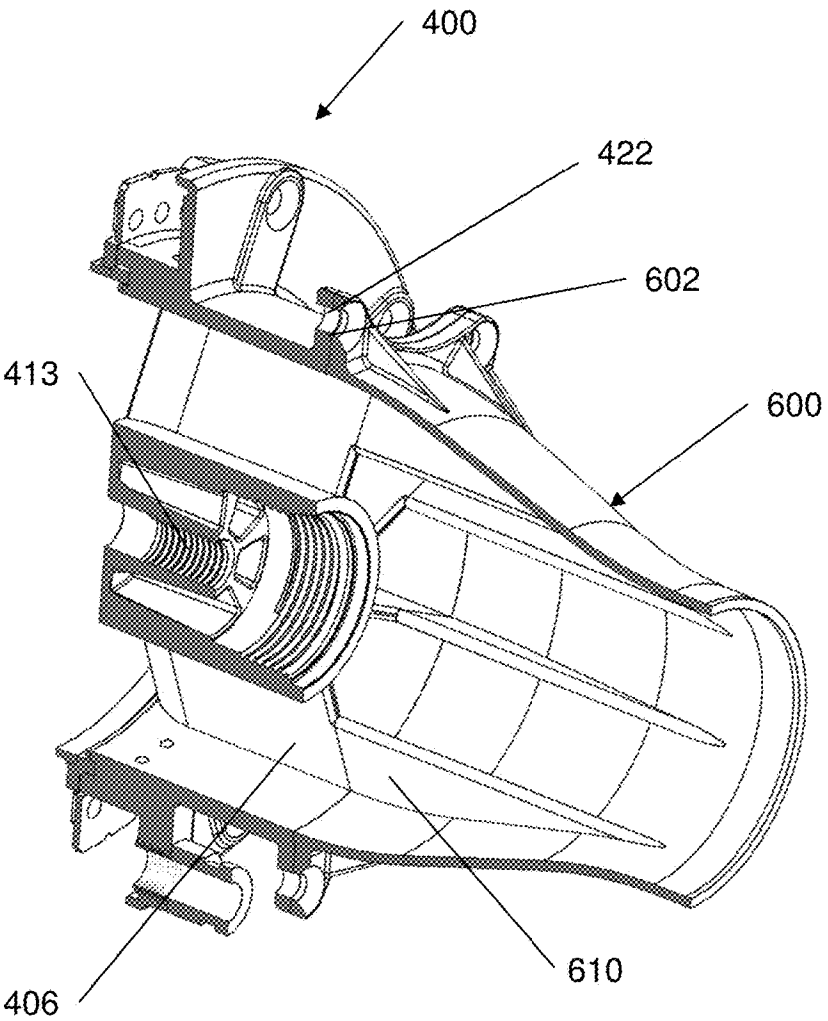
FIG. 8A is an isometric section view from the discharge perspective of the embodiment of the vane guide of FIGS. 7A and 7B coupled to the nozzle pump of FIGS. 6A and 6B.

FIG. 8A is a section view from the discharge perspective of the embodiment of the vane guide 400 positioned adjacent to the nozzle pump 600. FIG. 8B is a section view from the discharge perspective of the embodiment of the vane guide 400 positioned adjacent to the nozzle pump 600 with the addition of the discharge cone 500. As discussed above, the plurality of apertures 422 of the vane guide 400 are longitudinally aligned with the plurality of apertures 602 of the mounting flange 604 of the nozzle pump 600 to allow for the insertion of mounting screws (not shown). In certain embodiments, the mounting screws may be mated to an equal number of threaded acorn nuts to secure the nozzle pump 600 to the vane guide 400.

As can be seen in FIGS. 8A and 8B, when the vane guide 400 is coupled to the nozzle pump 600, the interior vanes 406 of the vane guide 400 are also aligned with the interior vanes 610 of the nozzle pump 600. In yet, other embodiments, the combination of the vane guide 400 and the nozzle pump 600 may be formed as a single piece in order to eliminate the weight of the mounting flanges 420, 604 and the associated hardware.

Operation

Figure 9A:
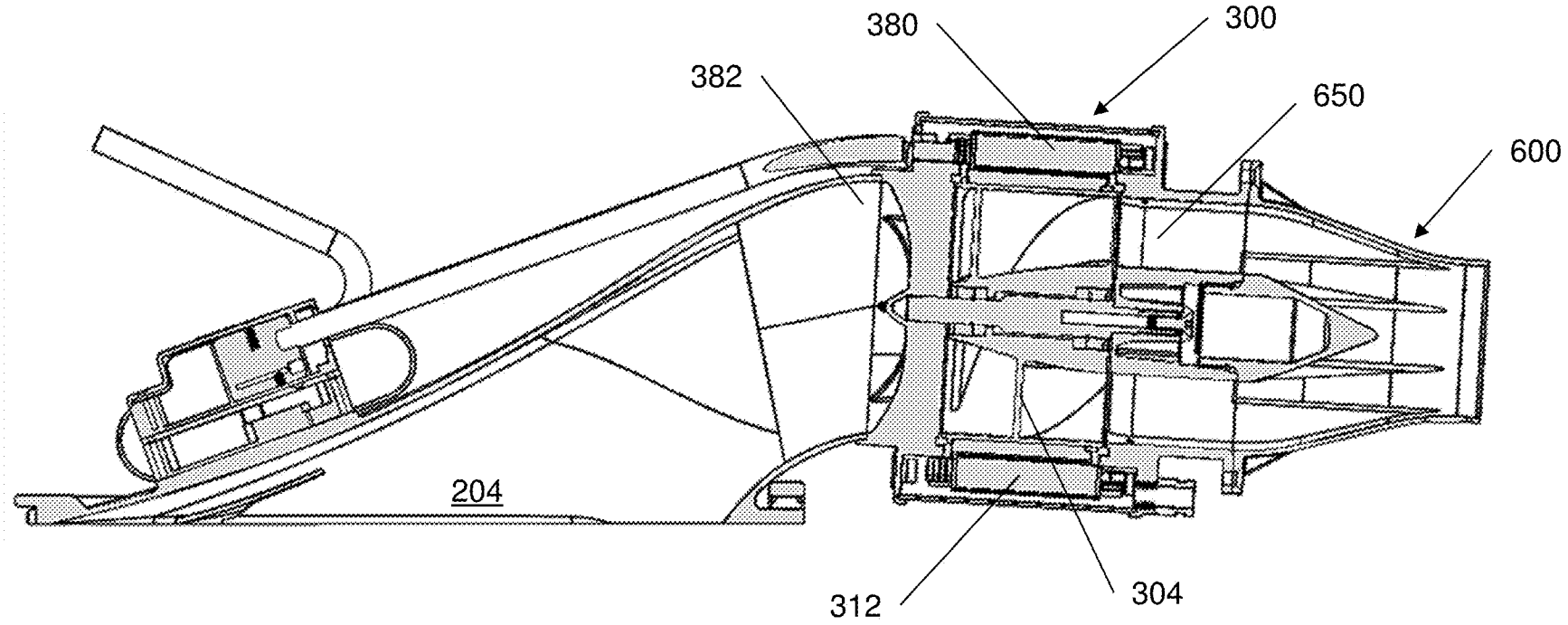
FIG. 9A is a longitudinal section view of the entire jet pump system of FIGS. 1A through 1D.

FIG. 9A is a longitudinal section view of the entire jet pump system 100. Referring now to FIGS. 9A, the manner of using one embodiment of the jet pump system 100 will now be described.

In use, the jet propulsion system 100 will be mounted inboard in the aft section of a vessel (not shown). In certain embodiments, the inlet mouth 204 of the inlet component 200 is positioned along the bottom of the vessel. At vessel speed, water is sucked through inlet mouth 204 and flows through to the motor-impeller unit 300. The turning of the impeller 304 increases the water pressure and discharges the water at a high velocity through the nozzle pump 600 at high velocity. The discharge of a high velocity stream of water generates a reactive force in the opposition direction which is transferred through the body of the jet pump system 100 to the vessel's hull, propelling the vessel forward.

As is well known, during operation, conventional electric motors will typically generate heat and cooling systems are introduced to manage the heat produced by the motor. In a conventional marine motorcraft cooling system, water is typically captured coming out of the propulsion system, removed from the fluid flow of the system, used to cool the motor or electronics, then the water is reintroduced back into the environment-resulting in less propulsion available to the system because some of the flow is used for cooling and not propulsion.

In contrast, in some of the disclosed embodiments, recirculated water is used for motor cooling. As will be explained below, in some embodiments, water is pushed or injected from a high-pressure compression zone 650 on the discharge side of the impeller 304 through the space between the sleeve 302 and the motor stator 380 back around to the inlet side region 382 of the motor-impeller component-which is a relatively low-pressure zone where the water is then sucked into the motor-impeller component. This results in a circulation where the high-pressure water from the back of the motor-impeller component 300 may be used to partially cool the motor.

In a conventional system, the impeller flings water to the exterior walls creating a turbulence which slows the overall water velocity and flow rate. However, when the water is recirculated around the motor-impeller component 300, turbulence is reduced so the flow volume stays relatively consistent. In other words, rather than the water being pushed against the exterior walls creating areas of turbulence and eddies, the water is being fed backwards around the motor stator to the inlet side. At the inlet side, the water is transferred back to the general flow to minimize any losses in flow volume. So, the flow volume stays relatively consistent throughout the entire system.

Figure 9B:
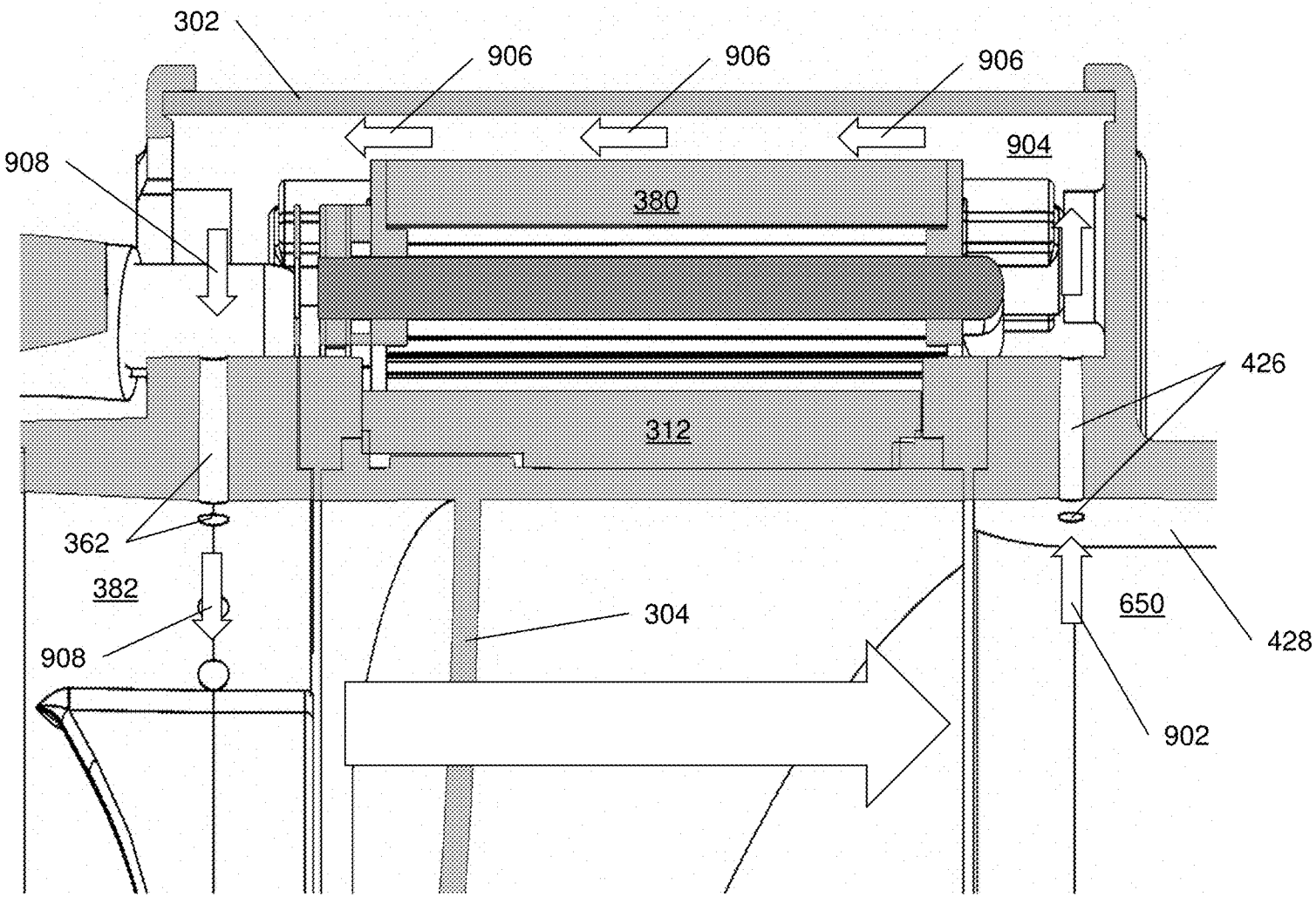
FIG. 9B is a not-to-scale detailed section view of a portion of the jet pump system of FIG. 9A.

FIG. 9B is a detailed section view illustrating one embodiment in which water may be recirculated to cool the motor. As water exits the area of the twirling impeller 304, it may be immediately "flung" against an interior wall 428 of the vane guide 400 to create a high pressure, turbulent zone 650 of flow and strong water pressure. In certain embodiments, some of the water from this high pressure zone 650 will be injected into inlet apertures 426 defined in the interior wall 428 of the vane guide 400. The direction of this fluid flow can be represented by arrow 902. In turn, the injected water exiting the inlet apertures 426 creates a high pressure zone 904 between a motor stator 380 and the sleeve 302—which creates a fluid flow back towards the impeller stabilizer 350 as indicated by arrows 906. This fluid flow then exits through a plurality of outlet apertures 362 as indicated by arrows 908. The water is then reintroduced into the lower pressure flow region 382 on the inlet side of the impeller 304. This creates a zero loss or near zero loss cooling system which will result in minimal loss of back pressure or minimal negative effects on the propulsion of the system.

Any low gravity solids and solids should be able to flow through the inlet openings 426 because they will be carried by the flow of the water circulating in zone 904. In order to reduce the likelihood that the solids are caught in zone 904, the inlet apertures 426 are of a smaller diameter (e.g., 2 mm) in the high-pressure zone 650 than the diameter of the outlet apertures 362 (e.g. 3 mm) so that if any solids enter into the pressure zone 904 will be flushed out by the pressurized water flow circulating between the motor stator 380 and the sleeve 302.

The circulation system described above passively cools the electric motor-eliminating traditional cooling lines and cooling systems-which minimizes the number of additional parts and weight and thereby providing increasing overall efficiencies of the system.

The abstract of the disclosure is provided for the sole reason of complying with the rules requiring an abstract, which will allow a searcher to quickly ascertain the subject matter of the technical disclosure of any patent issued from this disclosure. It is submitted with the understanding that it will not be used to interpret or limit the scope or meaning of the claims.

Any advantages and benefits described may not apply to all embodiments of the invention.

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above-described components and features may be individually or sequentially combined with other components or features and still be within the scope of the present invention. Undescribed embodiments which have interchanged components are still within the scope of the present invention. It is intended that the scope of the invention be limited not by this detailed description, but rather by the claims.

What is claimed is:

1. A marine propulsion system comprising:

an inlet conduit, including an inlet opening and an outlet opening, an electronic controller thermally coupled to the inlet conduit, an impeller positioned downstream relative to the outlet opening of the inlet conduit, the impeller including at least one impeller blade and a cylindrical outer shell coupled to the at least one impeller blade;

an electric motor coupled to the cylindrical outer shell of the impeller;

a nozzle positioned downstream relative to the impeller;

a plurality of de-swirling vanes positioned downstream of the impeller;

a vane guide positioned downstream from the impeller and upstream of the nozzle, the vane guide having at least a portion of the de-swirling vanes; and a cone having a threaded upstream end for mating with the vane guide and a pointed downstream end, the cone having a plurality of longitudinal slots for engaging a torque inducing instrument.

2. A method of cooling components of a water craft, the method comprising:

thermally coupling heat generating components of an electronic controller to an inlet conduit, causing a fluid flow through the inlet conduit by rotating an impeller hydraulically coupled to the inlet conduit wherein the impeller has an inlet side and an outlet side;

generating heat within the heat generating components of the electronic controller;

transferring a portion of the heat generated by the heat generating components to the inlet conduit through a thermally conductive plate embedded in the inlet conduit;

transferring a portion of the heat from the inlet conduit to the fluid flow such that the electronic components of the electronic controller are cooled;

extracting a portion of the fluid from the fluid flow on an outlet side of the impeller;

causing the extracted fluid to flow past an electric motor coupled to the impeller to transfer heat from the electric motor to the extracted fluid; and recirculating the heated extracted fluid back into the fluid flow on the inlet side of the impeller.

* * * * *